US010618154B2

(12) United States Patent
Marks

(10) Patent No.: US 10,618,154 B2
(45) Date of Patent: Apr. 14, 2020

(54) LOW FORCE RELEASE MANUAL TACKER

(71) Applicant: WORKTOOLS, INC., Chatsworth, CA (US)

(72) Inventor: Joel S. Marks, Sherman Oaks, CA (US)

(73) Assignee: WORKTOOLS, INC., Chatsworth, CA (US)

( * ) Notice: Subject to any disclaimer, the term of this patent is extended or adjusted under 35 U.S.C. 154(b) by 530 days.

(21) Appl. No.: 15/428,066

(22) Filed: Feb. 8, 2017

(65) Prior Publication Data

US 2017/0239798 A1 Aug. 24, 2017

Related U.S. Application Data

(60) Provisional application No. 62/299,398, filed on Feb. 24, 2016.

(51) Int. Cl.
*B25C 5/11* (2006.01)
*B25C 5/06* (2006.01)

(52) U.S. Cl.
CPC . *B25C 5/11* (2013.01); *B25C 5/06* (2013.01)

(58) Field of Classification Search
CPC ..... B25C 5/11; B25C 5/06; B25C 5/0242; B25C 5/025; B25C 5/0285
USPC ..... 227/132, 120, 134, 123, 129
See application file for complete search history.

(56) References Cited

U.S. PATENT DOCUMENTS

| | | | | |
|---|---|---|---|---|
| 6,789,719 | B2 * | 9/2004 | Shor | B25C 5/11 227/120 |
| 6,918,525 | B2 | 7/2005 | Marks | |
| 7,299,960 | B1 | 11/2007 | Marks | |
| 7,513,406 | B2 * | 4/2009 | Marks | B25C 5/025 227/120 |
| 7,540,400 | B2 * | 6/2009 | Zins | B25C 1/008 227/108 |
| 7,681,771 | B2 | 3/2010 | Kandasamy et al. | |
| 7,950,558 | B2 | 5/2011 | Marks | |
| 8,052,022 | B2 * | 11/2011 | Marks | B25C 5/11 227/120 |
| 8,453,903 | B2 | 6/2013 | Marks | |
| 8,978,952 | B2 | 3/2015 | Marks | |
| 2007/0108251 | A1 * | 5/2007 | Marks | B25C 1/008 227/120 |
| 2008/0308599 | A1 * | 12/2008 | Marks | B25C 5/0242 227/132 |

* cited by examiner

*Primary Examiner* — Hemant Desai
*Assistant Examiner* — Veronica Martin
(74) *Attorney, Agent, or Firm* — Paul Y. Feng; One LLP

(57) ABSTRACT

An energy storage tool includes a handle selectively linked to a power spring to deflect and store energy in the spring. The handle is decoupled from a link to the power spring by decoupling members in a release action. A peak release force results during the de-linking that is additive to a spring deflection force. An added motion bar adds leverage to the handle during the decoupling release action to reduce the peak release force.

6 Claims, 5 Drawing Sheets

FIG. 1
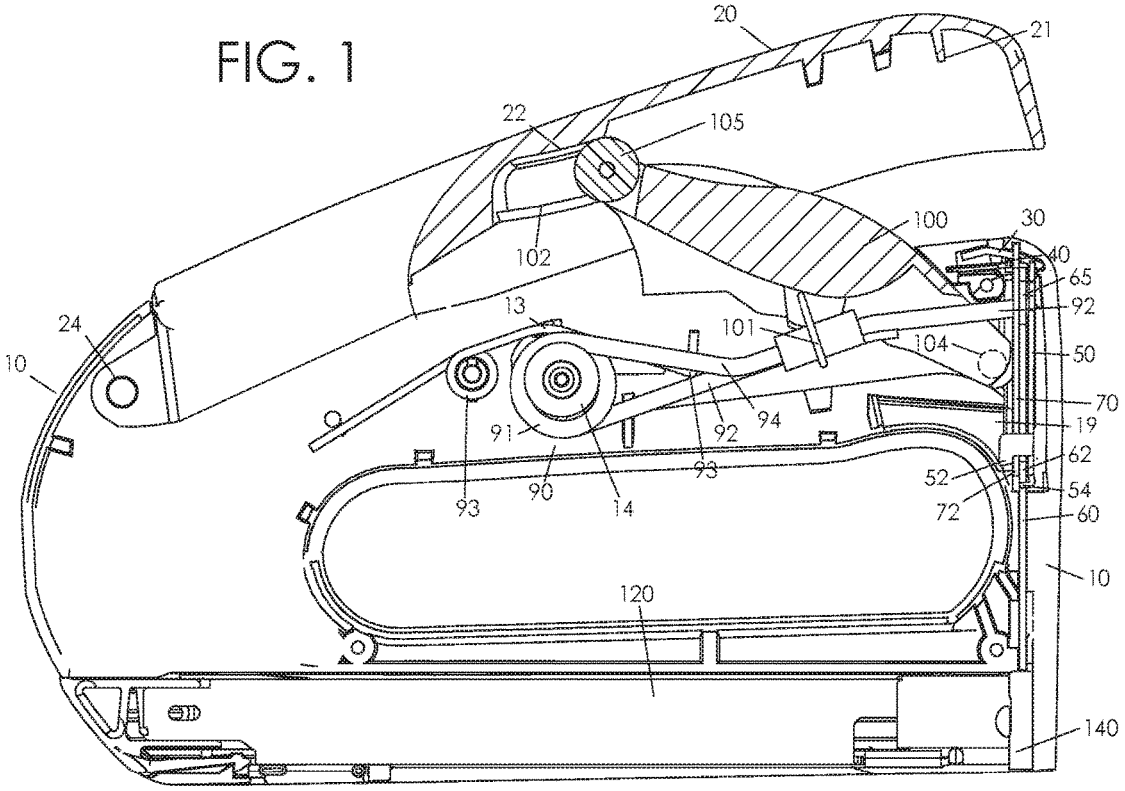
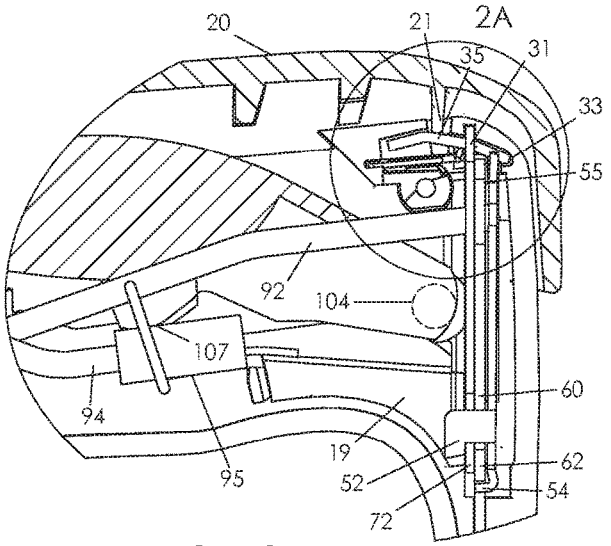
FIG. 2
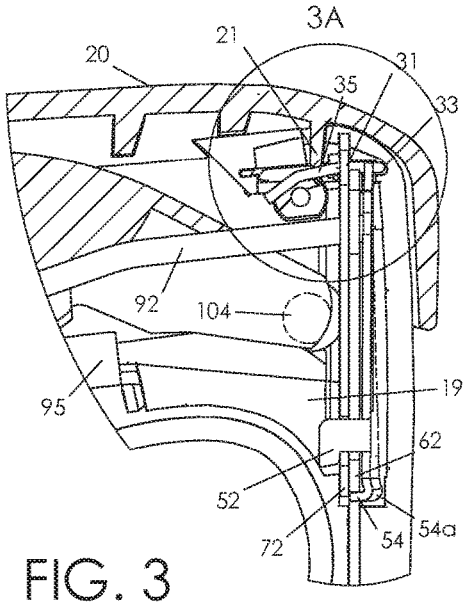
FIG. 3

FIG. 13
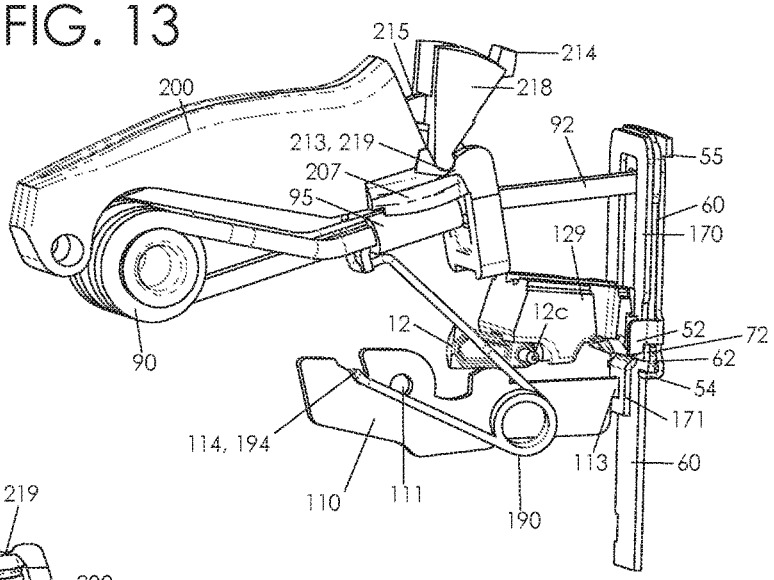
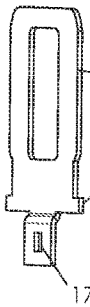
FIG. 18
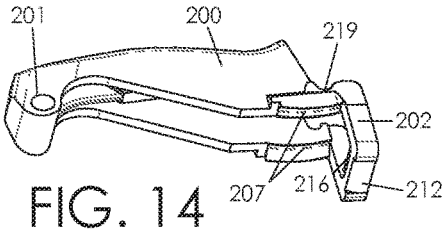
FIG. 14
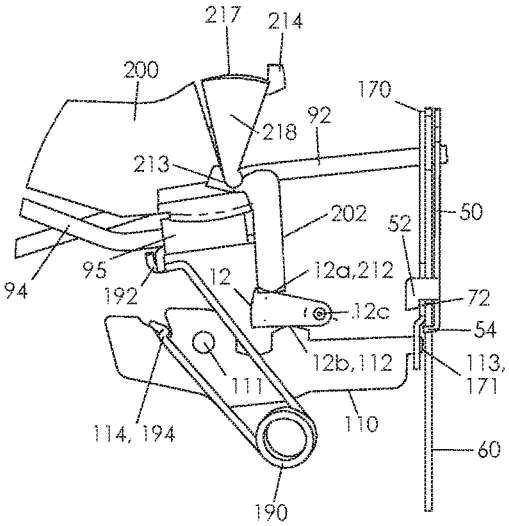
FIG. 15
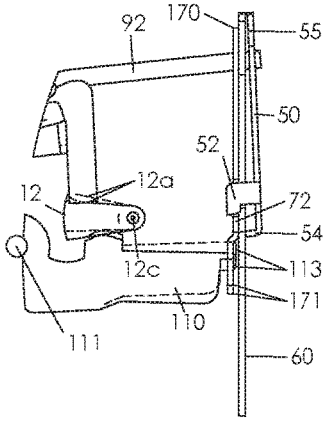
FIG. 16
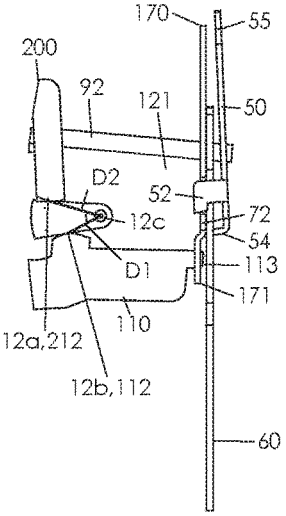
FIG. 17

LOW FORCE RELEASE MANUAL TACKER

CROSS-REFERENCE TO RELATED APPLICATIONS

This application claims priority from U.S. provisional application No. 62/299,398 filed Feb. 24, 2016, the entire contents of which are incorporated by reference.

FIELD OF THE INVENTION

The present invention relates to manual impact tools. More precisely, the present invention is directed to improvements to release of an energized spring in such a tool.

BACKGROUND OF THE INVENTION

Spring energized fastening tools include staple guns, nailers, desktop staplers and other such devices where storing and releasing energy to install a fastener is by impact blow. Other examples of such devices include, but are not limited to, using spring energy storage in marking tools where a mark or dent is placed in a work piece. In spring energized devices, a handle, lever or other movable member is moved to deflect a spring and store energy to be used on a driving piece. At a predetermined or selected point of operation, a holding member is released from the driving piece to allow the driving piece to move under the force of the deflected spring. This releasing action on the holding member occurs over a small portion of normal motion of the handle, lever or energy input device. The releasing action may require additional handle force that becomes concentrated at the small portion of motion. This will increase the peak force a user must exert on the handle, lever or equivalent structure.

SUMMARY OF THE INVENTION

The present invention includes a structure to reduce the added peak force from a decoupling releasing action. In a preferred embodiment, the structure increases the motion of the handle, lever or other equivalent member for the portion of motion that includes the releasing action. Increasing input motion typically corresponds to increasing leverage and therefore reducing a required operating force. According to a preferred embodiment, the added release motion diffuses an otherwise more concentrated release force.

BRIEF DESCRIPTION OF THE DRAWINGS

FIG. 1 is a right side elevational view of a tacker tool in a rest condition incorporating a release force diffuser. A right side housing is removed and partial section shown to view interior parts.

FIG. 2 is a cropped view of the tool of FIG. 1 in a start-of-release action condition.

FIG. 3 is the view of FIG. 2 in a pre-released condition.

FIG. 13 is a rear right perspective view of the rest condition tool of FIG. 10 with the housing, handle, and other parts removed for clarity.

FIG. 14 is a bottom perspective view of a lever of the tool of FIG. 10.

FIG. 15 is a side elevational detail view of the tool elements of FIG. 13 in a start-of-release-action condition.

FIG. 16 is the view of FIG. 15 with the elements in a pre-release condition.

FIG. 17 is the view of FIG. 15 with the elements in a released condition.

FIG. 18 is a rear perspective view of a variant of a latch holder.

DETAILED DESCRIPTION OF THE PREFERRED EMBODIMENTS

Figure 9:
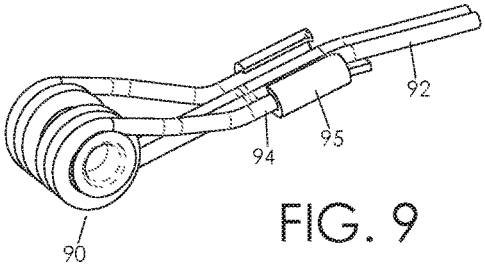
FIG. 9 is a right rear perspective view of a torsion power spring assembly.

FIGS. 1 to 8 show a forward action type staple gun or elements thereof wherein the handle is pressed toward a front of the tool and normally hinged near a rear of the tool body. FIGS. 10 to 18 show a rear action type staple gun or elements thereof with the handle pressed near a center or rear of the tool about a hinge located toward a front of the tool body. In the views, a wire power spring design is shown, generally of a type disclosed in U.S. Pat. No. 8,978,952 to the present inventor, the contents of which are incorporated by reference. In this design, shown in FIG. 9, a torsion spring or pair of torsion springs has two pairs of arms extending forward. One pair is deflected to energize the spring while a second pair moves with a striker. The power spring may be of other forms including compression, extension, flat metal formed or other known structures able to store energy.

In the rest condition of FIG. 1, handle 20 is in an upper position above body 10. Handle 20 pivots about hinge 24. Lever 100 links to power spring or power spring assembly 90 at handle cam 22 through wheel 105. Lever 100 is pivotally attached to body 10 at front hinge 104. Arms 92 engage striker 60 through opening 68, FIG. 8 while the striker is vertically movable in body 10. Latch 50 has lower shelf 54 which normally fits under edges or ears 62 of striker 60. See also FIG. 2. Latch 50 hangs upon tabs 55 pivotally mounted to body 10. As shown latch 50 directly engages striker 60. Optionally the latch may engage power spring 90 directly, not shown, with a link through the power spring to the striker.

Figure 4:
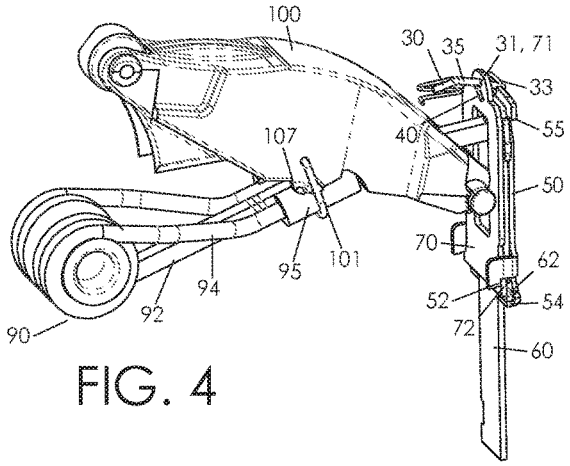
FIG. 4 is a right rear perspective view of the rest condition tool of FIG. 1 with the housing, handle, and other parts removed for clarity
Figure 5:
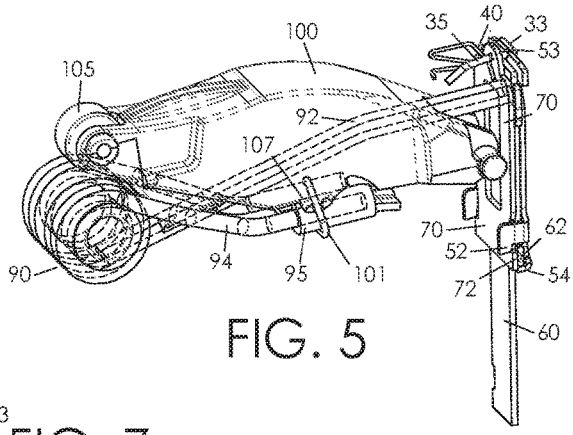
FIG. 5 is a right rear perspective view of the pre-release condition tool of FIG. 3.
Figure 7:
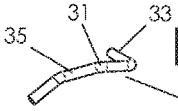
FIG. 7 is a right rear perspective view of an added motion bar.

Moving handle 20 downward to the position of FIG. 2 deflects power spring 90. As seen in FIG. 5, lever 100 presses spring arm 94 at fulcrum 107 in this condition. Bridge 95, FIG. 9, holds outer spring arms 94 in a pre-loaded position against inner arms 92. As shown in FIG. 4, fulcrum 107 presses spring arms 94 through bridge 95. Spring arms 92 then press downward on striker 60 at opening 68 in a force proportioned to the deflection of arms 94. The striker is held from moving downward by lower latch shelf 54. Shelf 54 is preferably angled downward, FIG. 2, so that the downward bias on striker 60 urges the shelf to slide out, being in a forward direction as shown, from under the striker. This sliding bias creates a rotational bias on stationary latch 50 at upper tabs 55. In turn, latch 50 is selectively immobilized or held from rotating by tabs 52 pressing flanges 72 of latch holder or holding element 70 as the latch holder remains in the corresponding upper rest position shown in FIGS. 1, 2 and 4; this holding condition persists through most of the lever and spring deflecting motion.

In FIGS. 3 and 5, the latch holder is in the pre-release position, having been moved incrementally downward by the structure described below preferably near the end of motion of the lever and power spring. Latch 50 is then free to rotate forward about upper pivot tabs 55 to the released position of FIG. 6, dashed limes in FIG. 3 at shelf position 54*a*. Striker 60, along with arms 92, has then instantly moved down to the position shown FIG. 6. The front face of striker 60 holds the latch in this forward position until the striker is returned to its upper position in a re-set action under bias of re-set spring 93, FIG. 1. As shown, re-set spring 93 pulls upward on arm 92 of power spring 90.

To move latch holder 70 downward requires a certain release force to overcome friction as it interacts with mating elements. This release force is additive to the handle force from deflecting the power spring, but being part of the system friction, it does not add any useful energy to the spring deflection. One source of such friction is the forward bias upon latch 50 from the angle of shelf 54 described above. Tabs 52 press flanges 72 so that, as latch holder 70 slides down, these features slide against each other at this interface. Latch holder 50 also then is pressed to slide against its guides of body 10 or other features. This friction can be reduced by proper selection of the angle for shelf 54. It needs to be angled enough to ensure that latch 50 will reliably slide out from under striker ears 62, but not so angled that this sliding bias and resulting friction is excessively greater than required. With this bias controlled, the friction at the latch holder/latch interface is also controlled. Another way to reduce the release force is low friction surfaces on the moving parts. For example, a hard nickel coating or other low fiction surface on latch holder 70 and latch 50 and/or other related parts will reduce sliding friction. However, there will normally be at least some residual friction in these actions.

A preferred embodiment release action includes a portion of handle travel in which the latch holder is engaged to move downward or other releasing or decoupling direction. It is preferred that the resulting striker release event occurs as close as possible to the handle's lowest position against body 10. In this way, any kickback or jumping motion of the tool is minimized since the handle will not suddenly move a large distance lower or beyond the release event. As described here, the release action is the selective engagement of components such as the latch holder or equivalent elements or effect that culminates in the instantaneous decoupling release event of the striker moving down. If the release event is too precisely at the handle lowest position, then the release action may fail to cause the release event if the handle hits it lowest position before the release event occurs. But with an excessively long release action and associated handle travel, there will be a less accurate release event. For example, a release action that includes about 25% or greater of the total handle motion will likely cause a less precise release event than desired since it will occur somewhere over that large release action handle travel. So a minimal but adequate handle travel distance is used for the release action consistent with the constraints in a preferably compact and reliable device for movements of the linked elements such as latch holder 70.

A feature of a preferred embodiment includes a structure to increase the release action handle travel while staying within the accuracy requirements discussed above. For example, the release action motion may be increased by two to three times through an added motion structure as disclosed below. Based on empirical observations, and the underlying geometry, this will inversely reduce the release force by about two to three times. With such a reduction, the release force can go from being a sharp peak in force and a hindrance to operation of a tool to being diffused or spread out and not a substantially noticeable addition to the total handle force. In the illustrated embodiments, the handle travel during the release action is about 4% to 5% inclusive of the outer limits of the total handle motion. So this is an increase from just about 1% to 2% inclusive of the outer limits that would be the case without the added motion. Other relative handle travel release motions may range from, for example, about 1% to 10% inclusive of the outer limits with improvements of the invention. Thus, a feature of the preferred embodiment includes a structure to diffuse a concentrated release action force.

In the forward action embodiment of FIGS. 1 to 8, handle extension 21 or equivalent trigger structure is fitted to handle 20. Handle 20 is omitted in the views of FIGS. 4 to 6 for clarity of the other components. In FIG. 1, extension 21 is spaced from other mechanical elements and does not interact with them. In the start-of-release action of FIGS. 2 and 2A, handle 20 is approaching its lowest position. Extension 21 begins to contact added motion bar, or force diffusing lever, 30 at pressing force input location 35 to rotate bar 30 downward about pivot 33. This momentary selective contact starts the release action. At the force output location of fulcrum 31, bar 30 passes through opening slot or edge 71 of latch holder 70; see also FIG. 8 for opening 71. According to the preceding description, handle 20, at a predetermined position, begins to cause latch holder 70 to move down to release striker 60 through a link path along the added motion bar between the force input location and the force output location. Extension 21 may include other equivalent structures that selectively link to latch holder 70 and may be more broadly called a release trigger. As described here the trigger is a part of a structure that is normally spaced and not engaged to other operative elements, for example added motion bar 30, of the device. The trigger operates to engage or link to and move the other elements only or primarily during the decoupling release action or release portion of the handle motion.

Figure 2A:
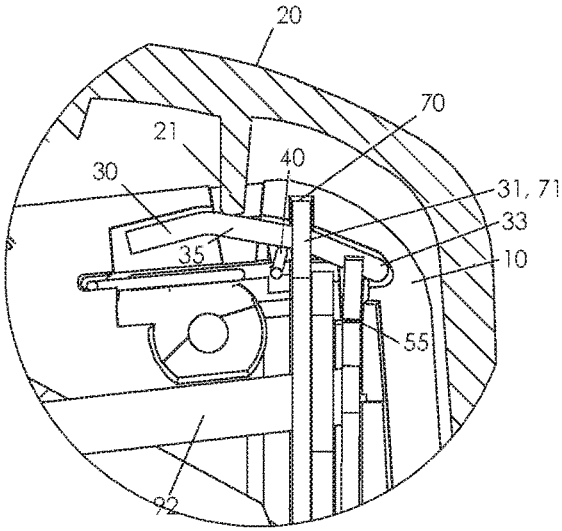
FIG. 2A is a detail view of the tool of FIG. 2.
Figure 3A:
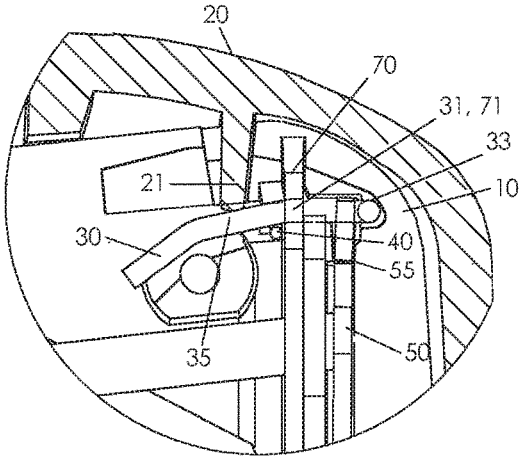
FIG. 3A is a detail view of the tool of FIG. 3.

At the prerelease position of FIGS. 3 and 3A, added motion bar 30 is pressed downward by extension 21 and bar 30 moves to the lower position shown. Latch holder 70 moves down in response, note the positions of leader 70 between FIGS. 2A and 3A. As discussed above, latch holder 70 moves down, or other release direction, about 2 to 3 times less than extension 21. Other suitable ratios may be used. Added motion bar 30 thus provides leverage to reduce the force needed to move latch holder 70 through the release action.

Bias spring 40 acts on bar 30 or other interface to move latch holder 70 back to its position of FIGS. 1 and 4 as part of a re-set action. As shown, bias spring 40 is a torsion type acting through a convoluted shape that fits largely within a left side housing of body 10 (see FIG. 5). Optionally the bias spring may press latch holder 70 from below or other locations, not shown. In this case the spring presses the latch holder upward directly rather than through bar 30.

In FIG. 3, a dashed line shows a released position of latch 50. Shelf 54 moves to the position of shelf 54*a*. The release event occurs at position 54*a* wherein striker 60 suddenly moves down to the lower position of FIG. 6. Latch 50 has rotated forward or other suitable direction about pivot 55 or other motion to free striker 60 to instantly move downward. As discussed above, the release event will be during the release action near to the lowest possible handle position but with sufficient over-travel that the release event reliably occurs before the handle stops moving. As described handle extension 21 moves downward faster than latch holder 70 during the release action from the leveraging action of bar 30.

Figure 8:
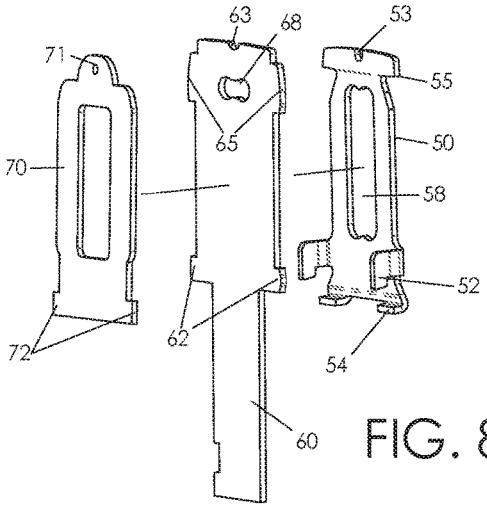
FIG. 8 is a right rear perspective exploded view of a latch holder, striker and latch.
Figure 6:
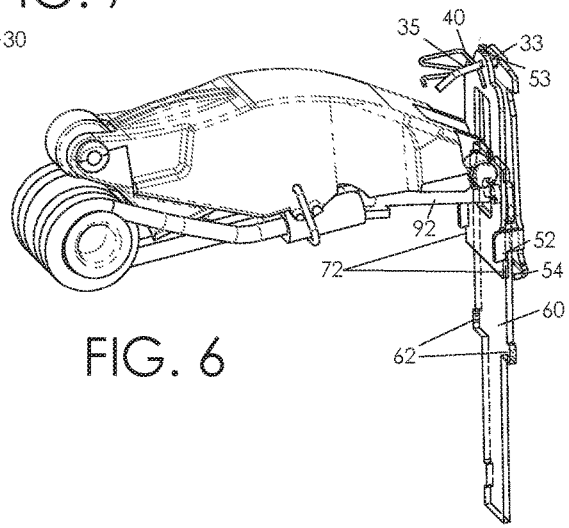
FIG. 6 is a right rear perspective view of a released condition tool.

Latch 50 includes opening 58 to fit a front tip of spring arms 92, FIG. 8. Alternatively, latch 50 may be bent so that it clears a front distal end of the spring arms (not shown). This configuration is optional, normally requiring extending the housing of body 10 farther forward to fit the bulge of the bent latch. With latch 50 coincident or behind the spring arm tips, the structure of the tool is compact, for example, at the location of the numeral 55 in FIG. 2A in front of latch 50.

Pull-up wire 101, FIG. 1, optionally maintains a tensile link between lever 100 and power spring 90. In the event that striker 60 is stuck in a lower position from a staple jam or other cause, this wire allows lever 100 to pull upward on power spring 90 and thus striker 60 to forcibly re-set the mechanism. In turn, handle undercut rib 102, FIG. 1, engages a tab or rib (not shown) of lever 100 allowing handle 100 to pull up on lever 100. Handle 20 thus maintains a loose tensile connection to striker 60 for anti-jam lifting.

Spring coil 91 should be a loose fit around post 14, FIG. 1. This allows for contraction of the coil during spring energizing deflection without binding the post. As shown, coil 91 is in a lower position around post 14 as occurs as handle 20 is initially pressed. With no force on handle 20, a natural position for the coil is higher on post 14 (not shown) from the upward bias of re-set spring 93. The "rattling" coil motion between these positions requires extra motion of handle 20 without useful energy input. Handle 20 then requires a higher rest position. To reduce this motion, body rib 13 preferably extends over the coil of spring 90 to hold the coil in the lower position shown. Rib 13 requires only a nominal clearance to the wire of coil 91 so that the wire can fit between rib 13 and post 14. Rib 13 therefore holds the coil in a down position to reduce the up and down rattling effect.

FIGS. 10 to 18 show the added release motion feature fitted to a rear action staple gun or equivalent tool. The operation of the illustrated power spring, latch, striker, and latch holder may be equivalent or identical to that of the forward action tool shown in the preceding drawing figures. For clarity and brevity, the same feature numbering is used for these parts and that description will not be repeated here. One exception is certain details of latch holder 170 described below.

Figure 10:
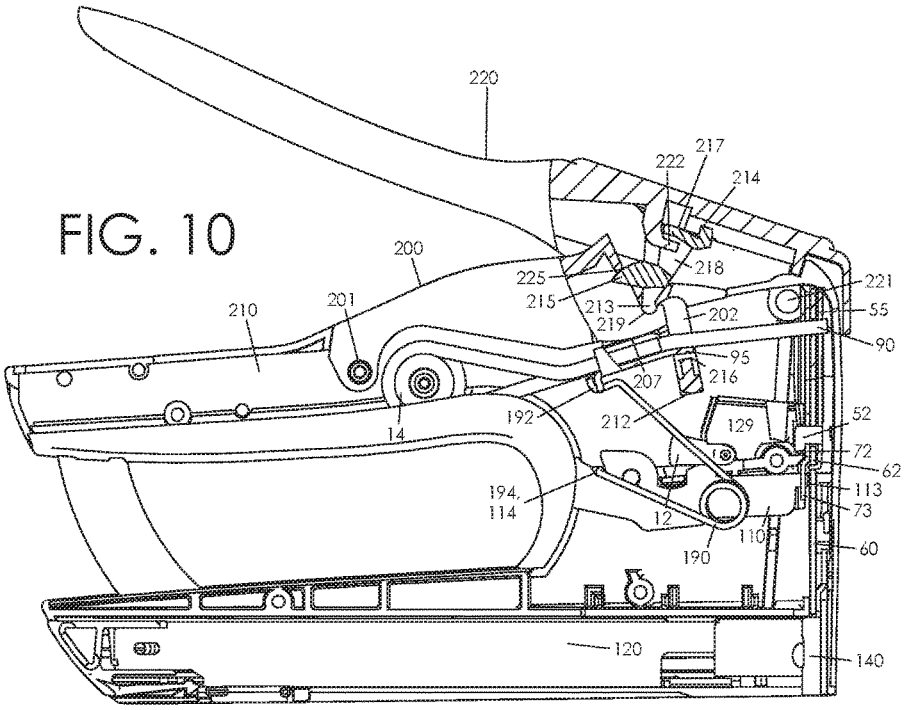
FIG. 10 is a right side elevational view of an alternative embodiment fastening tool in a rest condition incorporating a release force diffuser. A right housing is removed and partial section shown to view interior parts.
Figure 11:
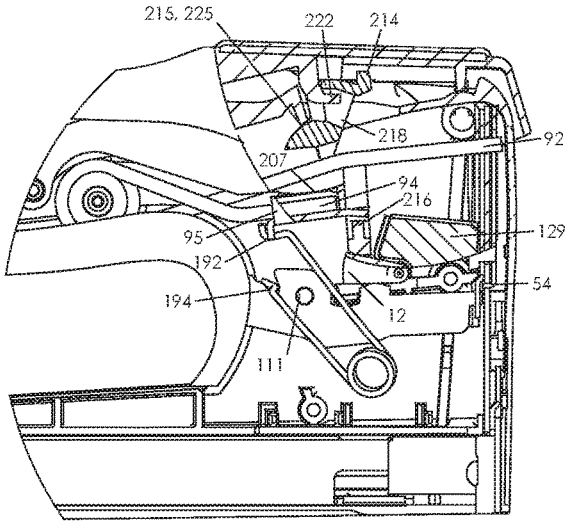
FIG. 11 is a cropped view of the tool of FIG. 10 in a pre-release condition.
Figure 12:
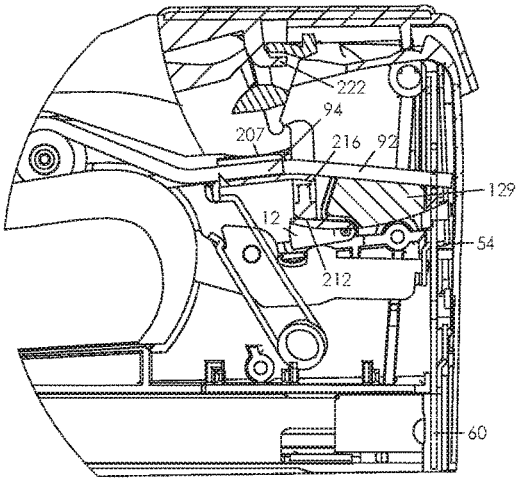
FIG. 12 is the view of FIG. 11 in a released condition.

In FIG. 10, handle 220 is pivoted about hinge 221 near a front of body 210. Link 218 transfers motion of handle 220 to lever 200 at link pivot 213 in lever pivot 219; see also FIG. 15. Lever 200 rotates about pivot 201 on body 210. As illustrated, link 218 is a partial wheel with an outer circumference 217. Circumference 217 rolls a limited distance along an interior of handle 220 as handle 220 moves. The rear action tool of FIGS. 10 to 18 includes a tensile link between handle 220 and striker 60 for a similar purpose as described above for the forward action tool—countering a stuck or jammed striker in a down position. Between lever 200 and spring 90, cross rib 216 passes under spring arms 92, FIG. 10, supported by arms 202 of the lever. As shown, a front extension of bridge 95 is the specific object that is selectively linked to cross rib 216. To pull striker 60 upward through spring arm 92, cross rib 216 may pull from below on the spring. Between handle 220 and lever 200 link 218 is the tensile connection. Protrusion 215 of the link extends into a recess of lever 220, below lever rib 225. When link 218 is pulled upward, protrusion 215 presses rib 225 in cooperation with pivot 213 to pull up the lever for all relative positions of link 218; compare FIG. 10 versus FIG. 11. Protrusion 215 is preferably arcuate with a center near pivot 213 as shown to maintain this selective link. Between handle 220 and link 218, extension 222 of the handle fits within a cavity of the link, as seen in FIGS. 10 to 12, below a rib or other feature of the link. Upward link tab 214 holds the link in a relatively constant position under handle 220 so that circumference 217 rolls in a controlled manner.

Lever 200 presses arm 92 of power spring 90 at fulcrum 207. As above this pressing may be through bridge 95.

In the exemplary embodiment, latch holder 170 is preferably actuated by handle 220 through intervening elements to provide the release action. As illustrated, there are preferably three such elements—lever 220, added motion bar 12, and re-set link 110. Lever cross rib 216 or other equivalent structure includes release interface or release trigger 212. See also FIG. 14. The lever and lever element of the release trigger are separately movable from the handle. In contrast the release trigger of FIGS. 1-8 is preferably an element of the handle. This surface 212 selectively presses added motion bar 12 at force input location 12*a* while bar 12 rotates about pivot 12*c*. In turn, force output location 12*b* of the bar presses cam 112 of re-set link 110. Re-set link 110 pivots on body 210 or other structure about pivot 111. These relations are shown directly in FIGS. 15 to 17. Optionally, lever 220 may press re-set link 110 directly. Further, lever 220 or other structure may directly selectively connect to latch holder 170.

Added motion bar 12 increases the portion of the motion of handle 220 that corresponds to the release action with the advantages described in detail above for the tool of FIGS. 1 to 8. To illustrate, FIG. 17 shows a distance D1 and a distance D2. D2 is the input torque arm that rotates bar 12. D1 is the output torque arm that rotates re-set link 110. D2 is greater than D1 so the lever 200 motion required to move re-set link 110 is increased. Added motion bar 12 increases the leverage available from lever 220 to move re-set link 110. Re-set link 110 engages latch holder 170 at opening 171, FIG. 18. Re-set link 171 can move latch holder both up and down as required.

In the exemplary embodiment, the leveraging ratio between D2 and D1 is about 1.5. This is less than a corresponding preferred ratio for the earlier structure of FIGS. 1 to 8 but sufficiently reduces the release force to be not easily noticeable by a user at handle 220. Other D2/D1 ratios, up to about 3 or more or less than about 1.5, for example, may be used and are contemplated. The preferred embodiment ratios, based on empirical observations, contemplates a range of about $3 \geq D2/D1 \geq 1.5$ with an exemplary ratio of 2 being also effective. As described, the leveraging ratio is the motion of the force input location to the force output location of the added motion bar in relation to a supporting structure such as housing body 10.

Re-set spring 190 biases power spring 90 upward to restore the released components of FIG. 12 to the rest condition of FIGS. 10 and 13. Lower arm 194 fits notch 114 of the re-set link. Upper arm 192 fits to bridge 95 or other suitable connection to power spring 90 or other suitable structure. Re-set spring 190 preferably provides a second function to normally bias re-set link 110 to rotate counter clockwise in the views. This force results from the location of notch 114 behind pivot 111. Link tip 113 urges latch holder 170 upward through engagement at opening 171. A larger distance between pivot 111 and notch 114 causes a larger re-set bias to latch holder 170. FIG. 16 shows both upper and lower positions of the latch holder and associated elements with the upper position in dashed lines. Re-set spring 190 is preferably an elongated torsion spring to fit beside re-set link 110. It can then fit compactly in the assembly of the tool, while a compression or other type of spring may be used instead.

Opening 171 is in a portion of latch holder 170 that is out of plane from a main portion of the latch holder. Link tip 113 can operate on latch holder 170 while remaining clear of striker 60.

In FIGS. 1 and 10, track 120 guides fasteners such as staples or nails toward nose piece 140. Striker 60 extends down into nose piece 140 in the striker low positions, for example, of FIGS. 6 and 12. Absorber 19 in the first embodiment and absorber 129 in the second provide a stop for a lowest position of the power spring arm 92 and striker 60.

As described above, an energy storage tool or device such as a staple gun includes a structure to deflect and energize a spring or other equivalent energy storage means. The energy of the spring is suddenly released to perform a desired function such as install a fastener or other impact work. Accordingly, a releasing means is required to decouple a link to the energizing structure from the spring. The decoupling occurs during a portion of the motion of a handle or energy input structure. In the illustrated embodiments, two staple gun type tools are shown. A first is a forward action tool, while the second is a rear action tool. Both are shown as "high start" type systems where an initial rest position has the striker positioned above a fastener guide track. A latch is biased to decouple from the striker but is held from doing so. Causing the latch not to be actively held to the striker is the decoupling, de-linking, or release action freeing the striker for movement.

Alternatively, the latch may be inherently stable to the striker wherein it is arranged or biased to stay coupled to the striker. For example, if the angle of shelf 54 is reduced, horizontal or reversed to be upward, then latch 50 will be stable under striker 60. In this configuration, not shown, handle 20, 220, lever 200, re-set link 110 or other suitable links or elements would be configured to force latch 50 forward to decouple the striker and release power spring 90. Latch 50 or shelf 54 thereof is the holding element in this configuration that selectively maintains the power spring in the deflected condition. The release action is the motion of this forcible active decoupling, for example, by directly moving shelf 54 out of engagement. By increasing the leverage from the handle (or equivalent structure) to cause this forcible decoupling, the peak release force is reduced as discussed earlier. An added motion bar similar to that of bar 30 or 12 can provide this force diffusion function in the alternative active decoupling design. In the contemplated configurations, the added motion bar may be in the form of a lever, a rotating cam, a translating wedge, or other structure that includes a substantial function to add leverage by amplifying input motion. Preferably, the added motion bar or feature operates with minimal sliding, for example, substantially by pivoting to its mating components as illustrated in this disclosure, for low friction action. Alternatively, low friction surfaces may include some sliding in the added motion feature.

In the preferred embodiment described herein, the release, de-link, or decoupling action is an identifiable secondary motion of components distinct from the normally continuous smooth motion of energizing the power spring and associated smoothly moving components linked thereto. Described another way, there is preferably a secondary "kick-off" action that occurs through a limited portion or segment of handle or other energy input motion to provide a relatively precise release event. In the illustrated embodiments, the kick-off action includes the downward motion of the latch holder. This secondary motion may include mating components that slide against each other, as seen, for example, in latch holder 70, 170 sliding against latch 60 and/or other mating features. The resulting friction is one reason that the release action can cause an obvious localized input force peak. Therefore, the added motion feature diffuses the peak force of the kick-off event, preferably through motions that include minimal sliding or low friction.

An added motion bar may also be used with a "low start" type stapler or fastening tool. In a low start configuration (not shown), the striker starts from a rest position in front of the staple track 120, normally within nose piece 140. Pressing the handle raises the striker and deflects the power spring at the same time. Near a top of the striker's motion, the handle is de-linked from the striker through a decoupling of linking elements between the handle and the power spring to allow the striker to be accelerated to eject a staple or fastener by impact blow. This decoupling motion may include a secondary kick-off release action. Such release action may include sliding motions with associated friction. As with the above disclosed embodiments, the low start configuration with the secondary release action preferably includes an added motion bar between the handle and the decoupling members to increase the distance the handle moves during the release action compared to with no added motion bar. This increased motion and leverage reduces the release force during the release action.

While the particular forms of the invention have been illustrated and described, it will be apparent to those skilled in the art that various modifications can be made without departing from the spirit and scope of the invention. It is contemplated that elements from one embodiment may be combined or substituted with elements from another embodiment.

What is claimed is:

1. A spring energized fastening device including a housing body, a power spring, and a striker movable vertically at a front of the housing, the fastening device comprising:

the power spring including a rest condition, a pre-release condition, and a released condition, the power spring being deflected from the rest condition to the pre-release condition to store energy in the power spring;

the striker linked to the power spring to selectively move between a first and a second vertical position upon the housing as the power spring moves from the pre-release condition to the released condition;

a latch selectively held in engagement to the striker by a latch holder element of the fastening device, the latch holding the striker in the first position against a force from the deflected power spring;

a handle movably attached to the housing including an initial position and a pressed handle position, and a handle motion between these respective positions;

an added motion bar linking the handle to the latch holder during a decoupling portion of the handle motion, the added motion bar pivotally attached to the housing including a force input location and force output location, the respective force locations rotating with the added motion bar;

the handle moving through a decoupling portion of the handle motion in a release action, wherein the handle presses the force input location to move the added motion bar, the force output location of the added motion bar being linked to the latch holder to move the latch holder and decouple the striker from the latch; and the added motion bar leveraging the motion of a handle link to the latch holder whereby the force input location moves during the release action substantially more than the force output location in relation to the housing body to diffuse a release force peak of the handle motion, and wherein the added motion bar engages a re-set link at the force output location, and the re-set link operates between the added motion bar and the latch holder to engage the latch holder.

2. The fastening device of claim 1, wherein the force input location moves between about 1.5 and 3 times more than the force output location.

3. The fastening device of claim 1, wherein a handle trigger presses the input location during the decoupling portion of the handle motion.

4. The fastening device of claim 3, wherein the force input location is toward a rear of the added motion bar, the pivotal attachment of the added motion bar is at a front of the bar, and the force output location is between the rear and the front of the bar.

5. The fastening device of claim 4, wherein the latch holder is slidably fitted to the housing body near the striker, the force output location engages the latch holder to selectively press and move the latch holder during the decoupling portion of the handle motion.

6. A spring energized fastening device including a housing body, a power spring, and a striker movable vertically at a front of the housing, the fastening device comprising:

the power spring including a rest condition, a pre-release condition, and a released condition, the power spring being deflected from the rest condition to the pre-release condition to store energy in the power spring;

the striker linked to the power spring to selectively move between a first and a second vertical position upon the housing as the power spring moves from the pre-release condition to the released condition;

a latch selectively held in engagement to the striker by a latch holder element of the fastening device, the latch holding the striker in the first position against a force from the deflected power spring;

a handle movably attached to the housing including an initial position and a pressed handle position, and a handle motion between these respective positions;

an added motion bar linking the handle to the latch holder during a decoupling portion of the handle motion, the added motion bar pivotally attached to the housing including a force input location and force output location, the respective force locations rotating with the added motion bar;

the handle moving through a decoupling portion of the handle motion in a release action, wherein the handle presses the force input location to move the added motion bar, the force output location of the added motion bar being linked to the latch holder to move the latch holder and decouple the striker from the latch;

the added motion bar leveraging the motion of a handle link to the latch holder whereby the force input location moves during the release action substantially more than the force output location in relation to the housing body to diffuse a release force peak of the handle motion, and wherein the added motion bar engages a re-set link at the force output location, and the re-set link operates between the added motion bar and the latch holder to engage the latch holder; and wherein the re-set link is normally biased to rotate to hold the latch holder engaged to the latch and thereby the latch engaged to the striker to hold the striker in the first position.

* * * * *